United States Patent [19]

Cvitas et al.

[11] Patent Number: 4,685,899

[45] Date of Patent: Aug. 11, 1987

[54] SOLID JACKET CENTRIFUGE

[75] Inventors: Vilim Cvitas, Leonding; Karl Faltejsek, Linz; Reinhart Hanke; Alois Janusch, both of Leoben; Gerhard Larch, Marienkirchen, all of Austria

[73] Assignee: Voest-Alpine Aktiengesellschaft, Linz, Austria

[21] Appl. No.: 724,963

[22] Filed: Apr. 19, 1985

[30] Foreign Application Priority Data

May 2, 1984 [AT] Austria ..... 1452/84

[51] Int. Cl.[4] ..... B04B 7/08

[52] U.S. Cl. ..... 494/44; 494/58; 494/82

[58] Field of Search ..... 494/44, 48, 47, 56, 494/79, 42, 85, 82, 83, 84, 58, 57; 210/781, 782; 422/72

[56] References Cited

U.S. PATENT DOCUMENTS 965,558 7/1910 Berrigan ..... 494/44

968,327 8/1910 Christianson ..... 494/44

2,199,848 5/1940 Bryson ..... 494/44

4,468,215 8/1984 Wimmer ..... 494/48

*Primary Examiner*—Robert W. Jenkins

*Attorney, Agent, or Firm*—Cushman, Darby & Cushman

[57] ABSTRACT

The solid jacket centrifuge is a plural chamber centrifuge (1). A housing (2) is, together with the centrifuge, stationarily supported, noting that a carrier (6) for cylindrical mantle surfaces (7 and 8) is provided within the housing (2). The cylindrical mantle surfaces (7 and 8) delimit annular chambers (9 and 10) and are shiftable in the direction of the axis of the shaft (3). There is further provided a screw conveyor (12) for introducing the material to be dewatered. The material to be dewatered enters the first annular chamber (9) via radial channels (15). By shifting the cylindrical mantle surface (7) in the axial direction, the material is discharged in a radial direction into the concentric greater annular chamber (10). When subsequently the mantle surface (8) is moved in the axial direction, discharge is again effected in the radial direction.

20 Claims, 8 Drawing Figures

SOLID JACKET CENTRIFUGE

BACKGROUND OF THE INVENTION

1. Field of the Invention

The invention refers to a solid jacket centrifuge comprising a rotatable and water-impermeable mantle surface adapted for being shiftable in an axial direction, a charging device for the material to be dewatered and at least one discharge means each for liquid and dewatered material.

2. Description of the Related Art

Such solid jacket centrifuges are frequently named decanters if they are provided with a discharge worn for continuous operation. Solid jacket centrifuges are known in the shape of bucket centrifuges and bottle centrifuges, respectively, or in the shape of tube centrifuges, noting that with a certain rotational speed the centrifugal force substantially exceeds the force of gravity, so that the liquid contacts the rotor wall in the shape of a ring extending in parallel relation relative to the axis. In such a construction, there is provided in the axial direction an overflow for a heavy fraction and an overflow for a light fraction if both fractions are liquids. Discharging of solid matter must, as a rule, be effected by peeling or by manual operation.

From DE-PS 438 904, there is already known a centrifugal machine in which discharge operation is effected by axially shifting the drum mantle. The dried material is in this case discharged in the axial direction.

SUMMARY OF THE INVENTION

The invention aims at further developing a solid jacket centrifuge of the initially mentioned type such that the centrifuge provides the possibility not only to separate solid matter from liquid matter but also to selectively treat the material to be separated, for example by wet-chemical decomposition or hydrolysis. Such a design is of particular importance in connection with the treatment of sewage sludges and of sludges containing rottable organic material, but also in connection with drying of wet coals, peat and so on by treating them with steam and simultaneously discharging the condensated steam and the water expelled from the material to be dried. The invention further aims at simplifying discharging of the separated fractions and at providing in a simple manner the possibility of semi-continuous or continuous operation.

For solving this task, the invention relates to a solid jacket centrifuge of the initially mentioned type. At least two compact (non-interrupted) mantle surfaces are successively arranged in a radial direction and are adapted for being independently driven to effect shifting movement in either axial direction. The discharge opening for the dewatered material is adjoining the mantle surfaces in the radial direction and can be opened by axially shifting at least one mantle surface. On account of the mantle surfaces being adapted to be driven for effecting a shifting movement in both axial directions of the centrifuge, discharging of the heavier fraction or solid fraction, respectively, can substantially be simplified by shifting at least one mantle surface.

If there are provided several compact mantle surfaces, each of which is adapted for being driven to effect shifting movement in a direction of its axis independent of the other mantle surfaces, the arrangement is conveniently such that at least one discharge opening for liquid is connected between mantle surfaces located adjacent one another in the radial direction. By separately shifting individual mantle surfaces in the axial direction of the centrifuge, the material treated or centrifuged within one section of the centrifuge can—after having separated the liquid phase—be transferred into a further section of greater radius, where the material is subjected to a greater centrifugal force on account of the greater circumferential velocity at the location of this greater radius in spite of the rotational speed of the centrifuge being the same. Annular chambers providing closed treating spaces are formed between the individual mantle surfaces. Within these annular chambers the desired reaction or hydrolysis, respectively, can be effected by spraying chemicals or by supplying steam into these chambers, noting that such a hydrolysis takes place simultaneously with centrifuging. By throwing the solid matter from a centrifuge section of smaller radius into a subsequent centrifuge section of greater radius, there results a mechanical swirling movement which promotes the desired reactions and improves the behavior during dewatering. For the purpose of making as small as possible the liquid ballast in an outward radial direction, one discharge opening for liquid each is provided between two adjacent mantle surfaces. The treating spaces thus formed may be subjected to different pressures, noting that any equalization of pressure between these treating spaces via their discharge conduits for hydrolysate is obstructed or impeded, respectively, by sealings or labyrinths.

Charging of such a solid jacket centrifuge can in a simple manner be effected by providing for the material to be dewatered. A central charging means preferably is equipped with a screw conveyor and opens via channels or perforations extending in a substantially radial direction into an annular chamber defined by a rotatable mantle surface and by front surfaces, noting that at least one front surface is fixed against being shifted in the axial direction. By means of such a central charging means, the material to be dewatered and to be treated, respectively, or the material to be hydrolysed can centrally be introduced and can—in case of a plurality of mantle surfaces located adjacent one another in the radial direction—be introduced into the innermost chamber which is defined by one of such mantle surfaces. After a first separation step and an optional pretreatment within this first chamber, the already pretreated or predried material can—by retracting the first mantle surfaces—be transferred into the next chamber which has a greater radius.

For providing the possibility to treat or hydrolyse the charge within individual annular chambers, it is preferred to connect a steam supply conduit to at least one annular chamber defined by mantle surfaces.

According to a preferred further development of the solid jacket centrifuge according to the invention, that front surface of the annular chambers which has the discharge opening for liquid is designed as a sieve surface, in particular as an annular surface comprising perforations conically flaring in an outward direction, and is fixed against being shifted in the axial direction. This front surface can in any case be designed as a front surface which is fixed in its location such that it can not be shifted in axial direction, noting that the shiftably supported mantle is pressed in its closed position against the front surface, for example against an annular step or against a centering cone of this front surface. However, also the front surface located opposite the front surface comprising the discharge openings for liquid is, in an advantageous manner, designed as a front surface secured against shifting movement in the axial direction, noting that this second front surface provides the stripper edge which—when shifting the mantle surfaces—strips the material adhering to the mantle surfaces off said mantle surfaces and that this second front surface makes sure discharging of the material occurs into the next chamber or through the discharge opening.

For guiding the mantle surfaces and in particular for maintaining their relative concentric position and thus for avoiding any unbalances, the mantle surface, in particular the front surface located opposite the discharge opening for liquid, is slidingly guided and supported on a mantle surface located along a smaller radius by means of at least one radial web.

The shifting drive for the mantle surfaces is in a particularly simple manner realized by the fact that the mantle surfaces carry annular discs guided within control cylinders and being at both of their sides subjectable to the action of a pressurized fluid, preferably by steam. In this case, the annular discs form the pistons sliding within the correspondingly shaped annular control cylinder spaces, and by subjecting the annular discs to the action of a pressurized fluid, axial shifting movement of the mantle surfaces can be obtained. For this purpose, the control cylinder spaces preferably can be connected via radial channels with an axially extending supply conduit for pressurized fluid, in particular with a steam supply conduit. In a particularly simple manner, the steam used for the hydrolysis reaction can be used for shifting the mantle surfaces in the axial direction of the solid jacket centrifuge. For the purpose of more exactly supporting the mantle surfaces in a sliding manner and in a manner preventing any unbalance over the whole shifting path of the mantle surfaces and also for the purpose of achieving reliable shifting movement of the mantle surface by subjecting respective annular surfaces to the action of low steam pressures, the arrangement is preferably such that at least one mantle surface carries two annular discs arranged in an axial distance one from the other exceeding the axial shifting path of the mantle surfaces and that at least one annular disc is penetrated by a paraxial tube for supplying pressurized fluid and is slidingly guided on this tube. By additionally providing a paraxial tube for supplying pressurized fluid, there results the possibility to actuate also the second annular disc in one of the shifting directions, and the paraxial tube simultaneously provides a rotational lock relative to a drive shaft. In this case, the paraxial tube must extend at least through one annular disc secured against rotation and non-shiftable in the axial direction, for reliably preventing any rotation relative to the drive shaft.

For controlling the shifting movement of the mantle surfaces by steam, a tubular slide valve is, in an advantageous manner, arranged within the axial steam supply conduit for being shiftable and for being driven in the axial direction, the mantle of the slide valve comprising perforations which—when shifting the tubular slide valve—can be brought in alignment with the radial channel (channels) or in a position covering said channel (channels). The tubular control slide valve can be connected with a correspondingly control drive means, and, in dependence on the shifted position of the slide valve, the associated mantle surface of the solid jacket centrifuge is shifted or shifted back, respectively, into the position in which this mantle surface contacts the front surface carrying the discharge openings. In dependence on which perforations of the mantle of the control slide valve are in alignment with a radial channel, the inner mantle or the next succeeding outer mantle, respectively, is shifted in the axial direction, and such an arrangement also provides the possibility to retract all mantle surfaces and thus to completely clean the centrifuge by retracting the control slide valve until a position in which all radial channels open into corresponding control cylinder spaces.

In a constructively particularly simple manner, the axial charging device for the material to be dewatered and the axial supply conduit for pressurized fluid are arranged within axial bores of a shaft. A carrier for the mantle surfaces is adapted for being driven to effect rotating movement and axial shifting movement and also is connected in a non-rotatable manner, which provides a particularly stable construction.

For operating this centrifuge, it is, with such a construction, only necessary to drive the shaft, and this can be effected without difficulties by conventional drive means, for example via V-belts. The hollow shaft is, in this case, particularly suitable to carry supporting elements acting in the radial direction and to make sure in this manner a concentric arrangement of the mantle surfaces is shiftable in the axial direction.

When retracting the mantle surface and discharging the material into an annular chamber of greater diameter or discharging the material in a direction towards the discharge opening, the front edges of those mantle surfaces, which are in closed condition in contact with the front surface comprising the discharge openings for liquid, are subjected to particularly severe mechanical stress and also to a stronger corrosive attack if aggressive hydrolysates are generated. For reliably obtaining a sealing effect in such cases and this over an extended operating interval, the arrangement is preferably such that the front surface of the mantle surfaces which is facing the front surface comprising the discharge openings for the liquid and optionally the front surface comprising said discharge openings, within the area of its contact with the front surface of the mantle, is (are) provided with an armor coating. A further protection against undesired corrosion can be achieved if at least the mantle surfaces of annular chambers subjected to steam pressure are lined with ceramic material.

For better distributing the material supplied by the charging device, there are, preferably, arranged on the shaft radially protruding drivers, in particular axially orientated metal sheets, extending into the first annular chamber. For subjecting the material introduced via the shaft to the hydrolysing action of vapors for some time interval and under a relatively low action of centrifugal force, it is also possible to use in an advantageous manner shovel-like drivers and conical surfaces, in particular conical surfaces with a small angle of opening.

To keep the supply speed independent of the rotating speed of the shaft, the arrangement is, in case of a conveyor screw, in a particularly simple manner such that within the axial bore of the shaft accommodating the charging device, a stationary tube is bearingly supported, within which the conveyor screw can be driven with an adjustable rotating speed. The shaft itself can in this case be connected with the rotational drive of the preferably adjustable rotating speed.

For completing discharging and for preventing any accumulation of adhering particles within the interior of the housing, for example, at the side located opposite the discharge opening, the mantle surface arranged along the greatest diameter carries, in an advantageous manner, on its outer side a peeling knife, which cooperates with the inner wall of the housing when shifting this mantle surface in the axial direction.

In the following sections, the invention is further illustrated with reference to an example of an embodiment shown in the drawings.

DETAILED DESCRIPTION OF THE PREFERRED EMBODIMENTS

Figure 1:
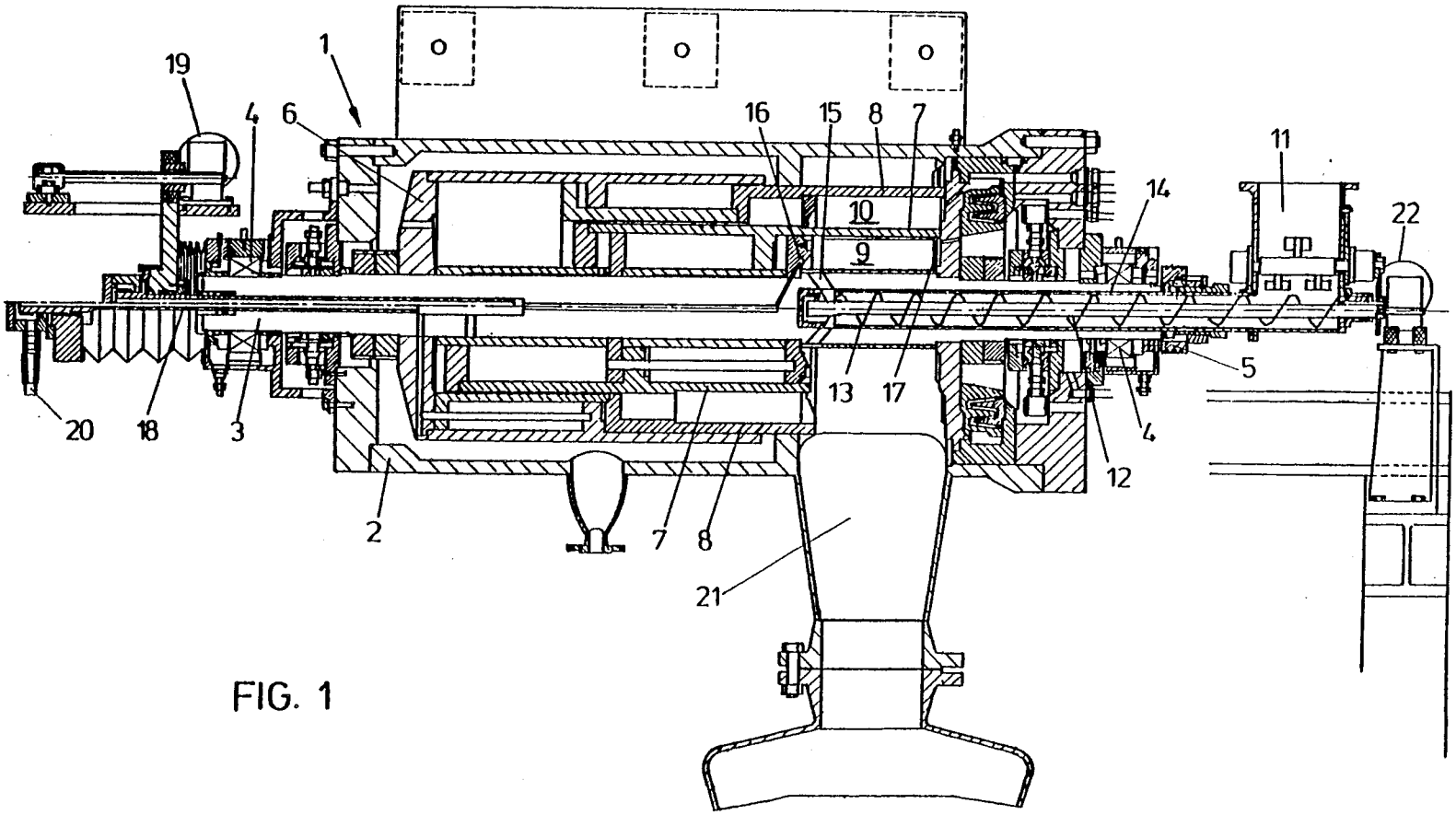
FIG. 1 shows a longitudinal section through the solid jacket centrifuge according to the invention.

In FIG. 1, there is shown a plural chamber centrifuge 1. The housing 2 of this plural chamber centrifuge, which is designed as a solid jacket centrifuge, is stationarily supported. A drive shaft 3 is rotatably supported within this housing 2 by bearings 4. For driving purposes, a V-belt pulley 5 is non-rotatably connected with the shaft 3. Within the housing, a carrier 6 for cylindrical mantle surfaces 7 and 8 is arranged and non-rotatably connected with the shaft 3. Both cylindrical surfaces 7 and 8 define annular chambers 9 and 10 and can be shifted in the axial direction of the shaft 3 as is illustrated in the lower portion of FIG. 1.

The material to be dewatered is charged via a supply hopper 11 and a screw conveyor 12, which is housed within an axial bore 13 of the shaft 3. A mantle tube 14 of the screw conveyor 12 is inserted into this bore 13 and stationarily supported for allowing relative rotation of the shaft 3 relative to this mantle tube 14. The material to be dewatered and to be treated, respectively, is introduced via substantially radially extending channels 15 into the first annular chamber 9, which is limited in the radial direction by the innermost of both cylindrical mantle surfaces 7 and 8. Front surfaces 16 and 17 are provided in the axial direction, said front surfaces being non-shiftable in the axial direction relative to the shaft 3 and forming further limiting walls of the annular chamber 9. The front surface 17 is designed as an annular disc and carries perforations for the discharge of liquid.

A control slide valve 18 is arranged within a further axial bore of the shaft 3 and can be shifted in the axial direction of the shaft 3 by a drive means 19. A steam supply conduit is connected to the interior of said tubular control slide valve 18 via a connection 20, the steam supplied being used as the pressurized fluid for the shifting movement of the cylindrical mantle surfaces 7 and 8.

The discharge opening 21 adjoins both annular chambers 9 and 10 and serves the purpose of discharging therethrough the dewatered and treated material.

The drive means 22 for the conveyor screw 12 is schematically designated.

Figure 2:
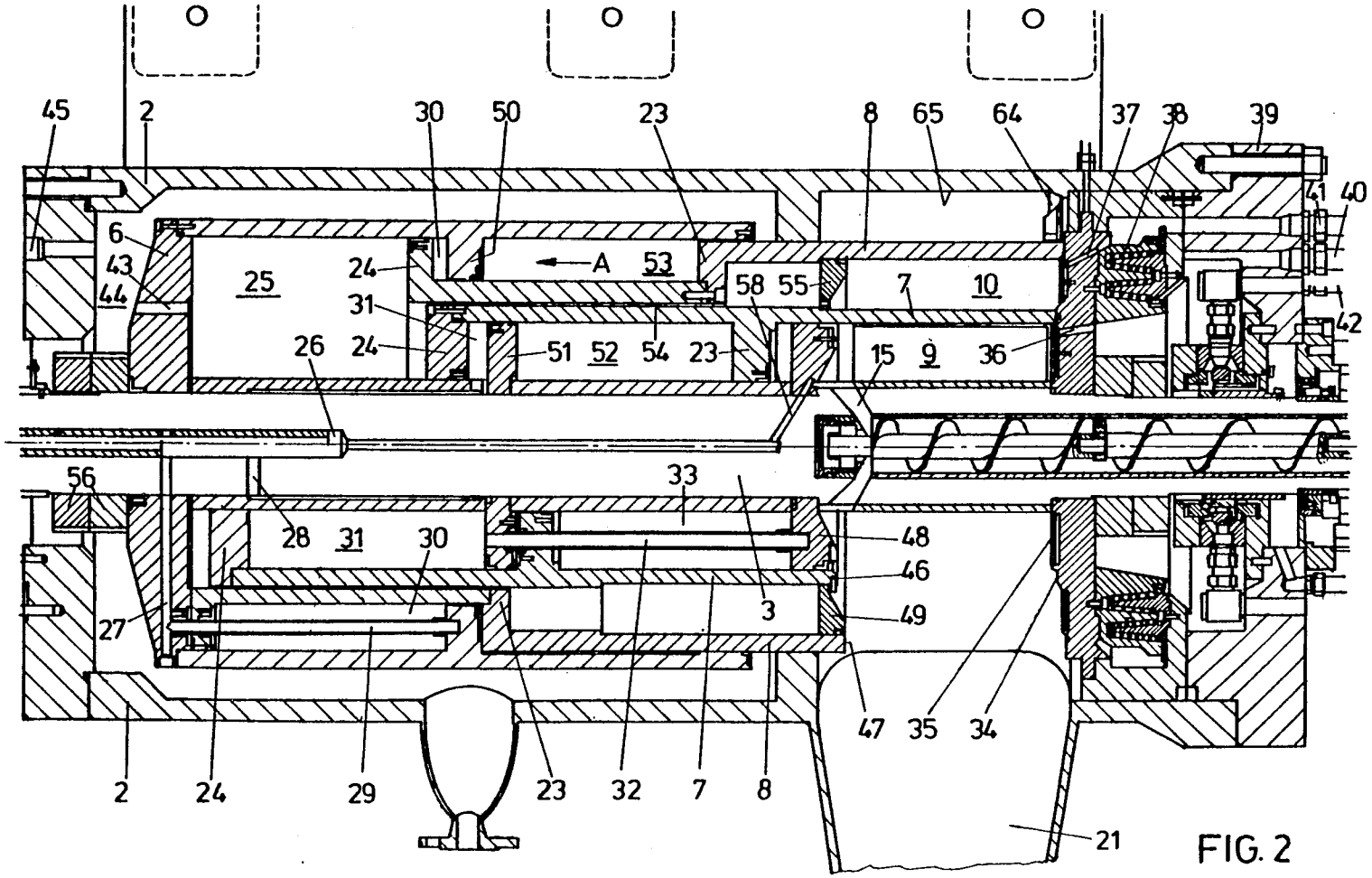
FIG. 2 shows in an enlarged representation the middle area of the construction according to FIG. 1.
Figure 3:
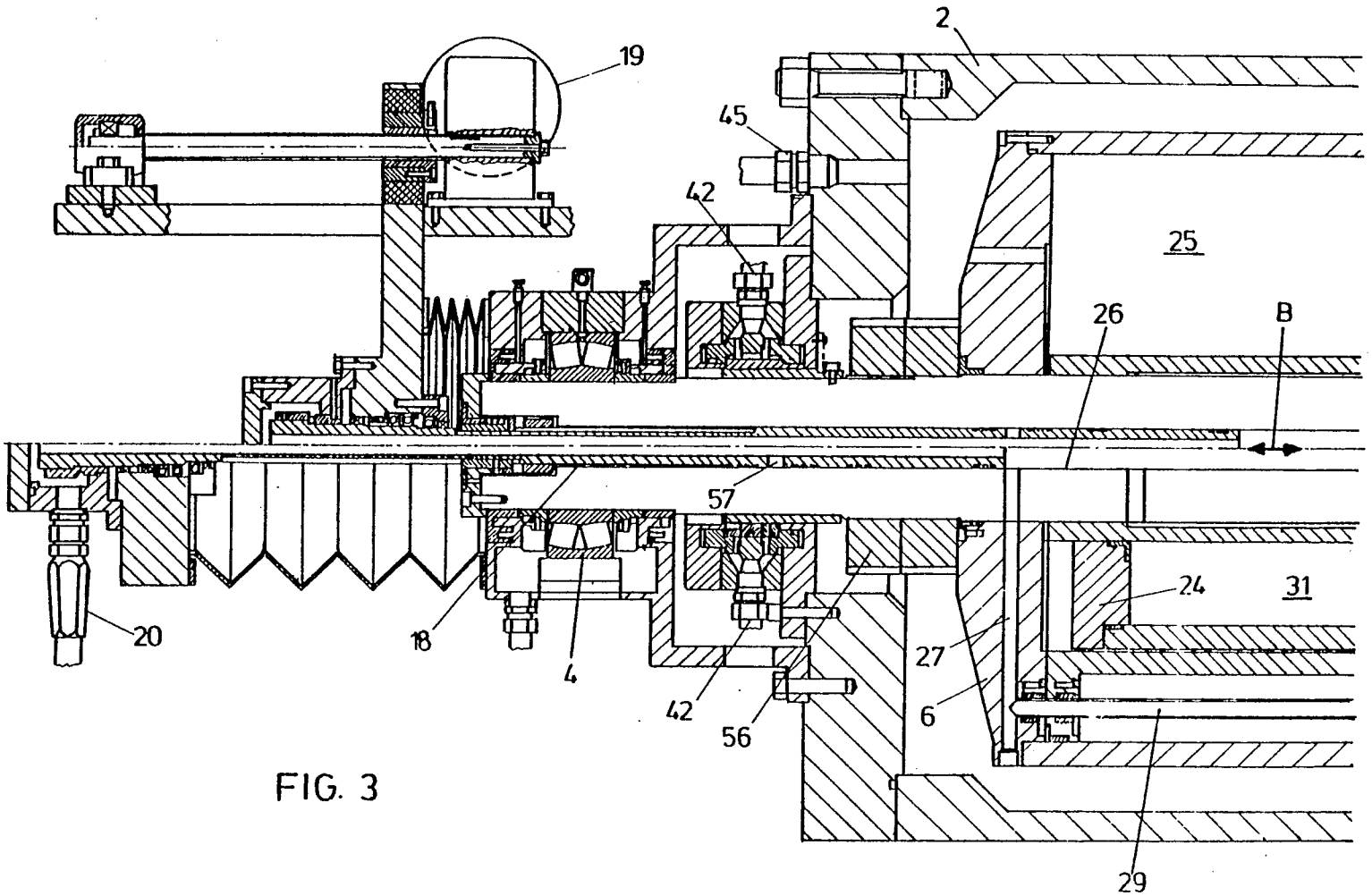
FIG. 3 shows in accordance with the representation of FIG. 1 and in an enlarged representation the area of the tubular control slide valve for driving the mantle surfaces.
Figure 4:
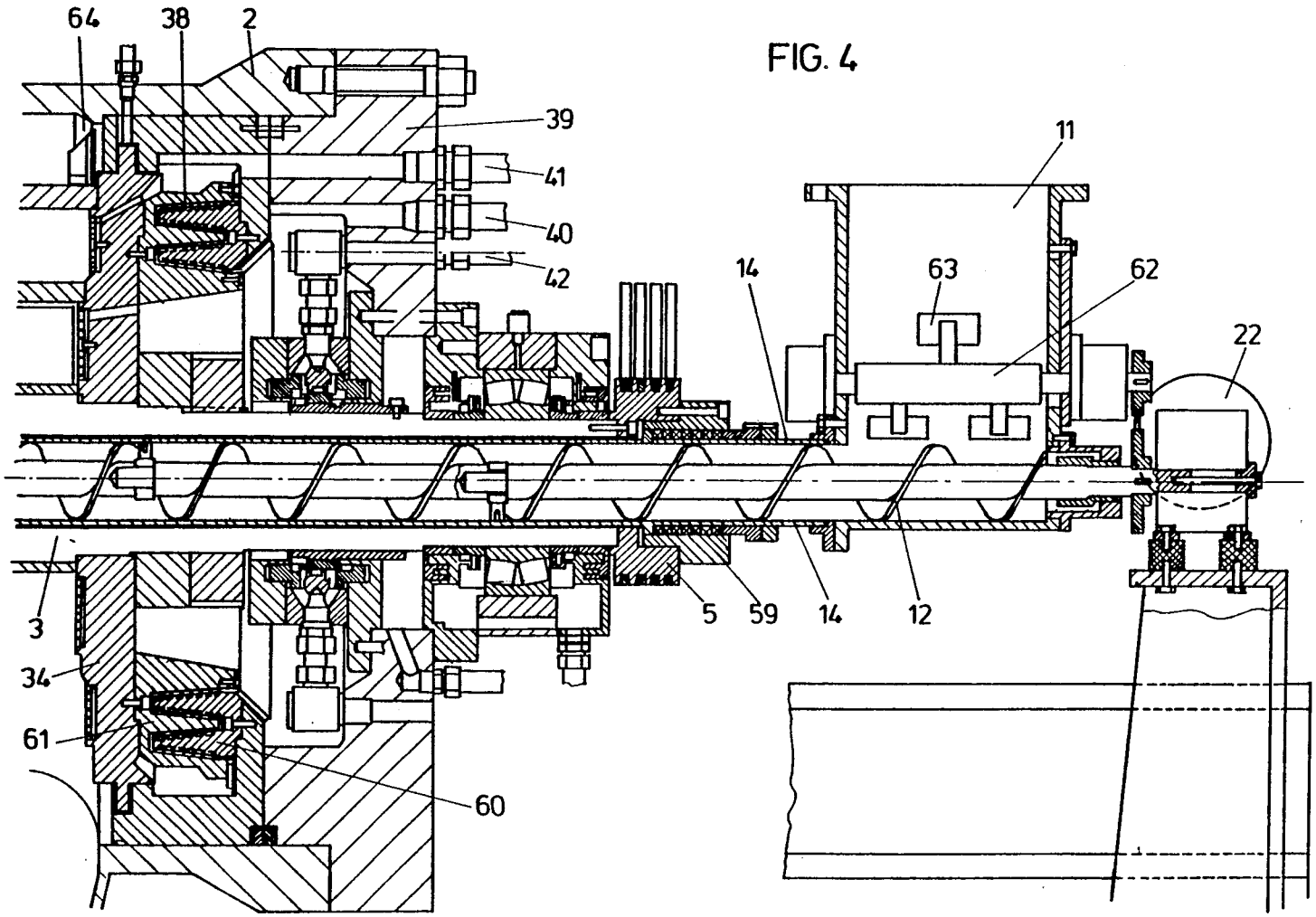
FIG. 4 shows in an enlarged scale the area of charging the material to be dewatered and to be treated in accordance with FIG. 1, and FIGS. 5 to 8 show schematically various positions of the control slide valve for controlling the shifting movement of the mantle surfaces.

The details of the solid jacket centrifuge shown in FIG. 1 can more clearly be taken from FIGS. 2, 3 and 4. FIG. 2 shows in an enlarged scale the housing 2 of the centrifuge, the cylindrical mantle surfaces delimiting the chambers 9 and 10 and the annular discs 23 and 24 which are guided within a common cylinder space 25 and form control pistons. By these annular discs 23 and 24, annular control cylinder spaces are defined into which pressurized fluid can be introduced for shifting the cylindrical mantle surfaces 7 and 8. For this purpose as shown in FIG. 3, radial bores 27 and 28 are provided which start from an axial bore 26 in which the control slide valve 18 is guided. The radial bore 27 opens via a paraxial tube 29 into an annular chamber 30, shown in FIG. 2, for the outer cylindrical mantle surface 8. By filling the annular chamber 30 with pressurized fluid, in particular with hot steam, the cylindrical mantle surface 8 is shifted in direction of the arrow A into the end position shown in the lower half of FIG. 2. Likewise, by supplying pressurized fluid into the radial bore 28, the pressurized fluid or steam, respectively, can be pressed into annular control cylinder spaces 31 and—via a paraxial tube 32—into a further annular control cylinder space 33, so that also the innermost of both cylindrical mantle surfaces 7 can be shifted into the end position shown in the lower half of FIG. 2. If both cylindrical mantle surfaces 7 and 8 are simultaneously shifted as it is shown in the lower portion of FIG. 2, the interior of the centrifuge is easily accessible for cleaning purposes. The front surface 34 of both annular chambers 9 and 10 is provided for each annular chamber 9 and 10, respectively, with separate discharge openings for liquid, which are formed of perforated annular discs 35. The liquid coming from the annular chambers 9 and 10 is removed via essentially axially extending passages 36 and 37, said front wall 34 rotating with the rotating speed of the shaft 3. A labyrinth seal 38 is provided between the passages 36 and 37 and has its parts on the one hand stationarily screwed to the cover plate 39 of the housing 2 and on the other hand with the front surface 34. Discharge conduits 40 and 41 for the liquid discharged from the annular chambers 9 and 10 as well as a rinsing conduit 42 for cleaning the bearing surfaces of the shaft relative to the stationary housing 2 are connected to the stationary cover plate 39.

The cylindrical space 25 is connected with the interior space 44 of the housing via a bore 43 of the carrier 6, said interior space 44 having connected thereto a steam supply conduit via a connection 45. When supplying steam via the connection 45 if the axial supply bore 26 is not subjected to pressure and thus no control pressure is acting within the annular control cylinder spaces 30, 31 and 33, it is possible to move the cylindrical mantle surfaces 7 and 8 in the opposite direction of arrow A into their operating position shown in the upper portion of FIG. 2, in which position the front surfaces 46 and 47 of these mantle surfaces 7 and 8 are sealingly pressed against the front surface 34. Within the area of contact, the front surface 34 as well as the front surfaces 46 and 47 of the cylindrical mantle surfaces 7 and 8 are provided with an armor coating for better resisting mechanical stress.

The annular chambers 9 and 10 are further limited by annular discs 48 and 49, which are fixed for not being movable in the axial direction and which have those edges designed as stripper edges which contact the inner side of the cylindrical mantle surfaces 7 and 8. These annular discs 48 and 49 facilitate concentric guidance of the cylindrical mantle surfaces 7 and 8 when shifting them in the axial direction and for this purpose there are additionally provided supporting webs 50 and 51 being connected with the carrier 6 in a manner prohibiting shifting them in the axial direction.

For shifting the cylindrical mantle surfaces 7 and 8 in the direction of the arrow A, the annular chambers 52 and 53 must of course be pressure-relieved, for which purpose pressure-relief bores (not shown in FIG. 2) are provided. An annular gap 54 is provided between component parts of the cylindrical mantle surfaces 7 and 8 which carry both annular discs 23 and 24 and steam can via a bore 55 of the front annular disc 49 be pressed through this gap from the cylindrical space 25 into the outer annular chamber 10.

The tubes 29 and 32 are fixed to the annular discs 48, 51 as well as 50 to the supporting web. Tubes 29 and 32 are non-shiftable in the axial direction and are fixed to the front plate of the carrier 6. Tubes 29 and 32 have outlet openings opening into the corresponding control spaces. By fixing the position of the tubes 29 and 32 in the indicated manner, a further guiding means for the shifting movement of the mantle surfaces 7 and 8 is provided. This guiding means simultaneously reliably prevents relative rotation between these mantle surfaces 7 and 8, on the one hand, and the carrier 6 or the drive shaft 3, on the other hand.

The carrier 6 is non-rotatably connected with the shaft 3 by keys 56.

FIG. 3 shows in an enlarged scale and in a representation analogous to that of FIGS. 1 and 2 the tubular control slide valve 18. Actuation of the tubular control slide valve 18 is effected by means of a drive arrangement 19 designed as a spindle drive. The control slide valve 18 has its mantle provided with perforations 57 which can be brought in aligned connection with the radial bore 27 by shifting the tubular control slide valve 18 in the sense of the twin-arrow B. The tubular control slide valve 18 can be subjected to the action of steam via the connection 20, so that—in dependence on the position of the tubular slide valve 18—both cylindrical mantle surfaces 7 and 8 can be moved independently one from the other or in common.

The receiving bore 26 extends in the axial direction of the shaft 3 and—as can be taken from FIG. 2—till near the end of the central screw conveyor. It is possible to introduce—via an essentially radial bore 58 and via said axial bore 26—steam also into the inner annular chamber 9, so that hydrolysis can also be effected within this annular chamber.

FIG. 4 shows in an enlarged scale the screw conveyor 12 having already been explained in FIG. 1. The mantle tube 14 penetrates through a bushing 59 and can thus be prevented from rotation relative to the shaft 3. A component part 60 of the labyrinth seal 38 is connected with the stationary front plate 39 of the housing 2 in FIG. 4, while the component part 61 of this labyrinth seal 38 rotates with the front surface 34.

The rotary drive 22 for the screw conveyor 12 is coupled via a gearing with a shaft 62 arranged within the charging hopper 11 and is provided with distributing vanes 63 for uniformly distributing the material over the width of the screw conveyor 12.

Figures 5, 6, 7, 8:
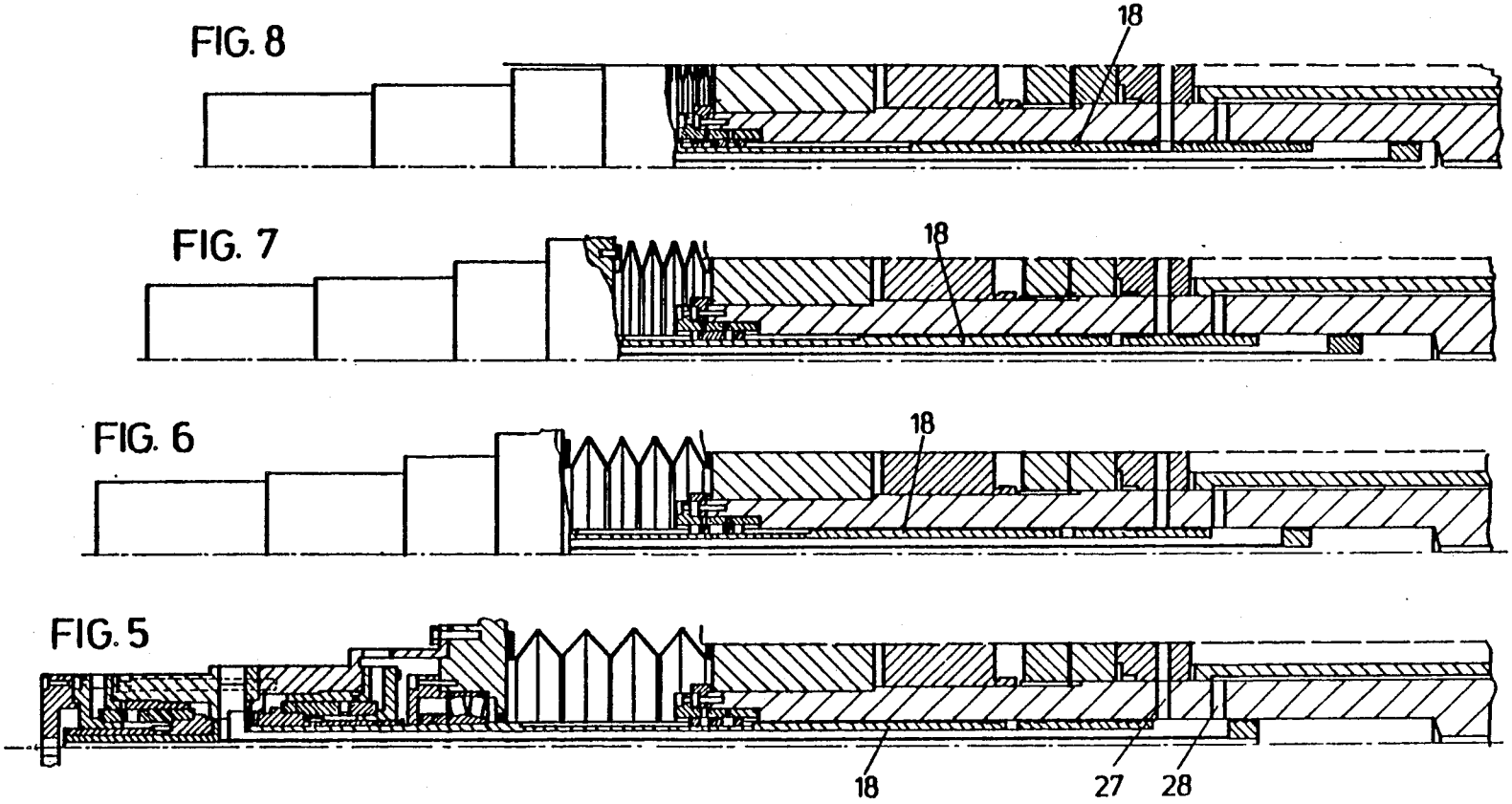

From the representation according to the FIGS. 5 to 8, there can be taken the respective position of the control slide valve 18 for different operating conditions. In the position of the control slide valve 18 in accordance with FIG. 5, both channels 27 and 28 are in open condition and—with a deactivated supply of pressurized fluid or steam via the connection 55 and when subjecting these bores 27 and 28 the action of pressurized control fluid or steam—both annular chambers 9 and 10 are opened. This position allows cleaning of the centrifuge. In the representation according to FIG. 6, only the radial bore 28 is opened. This position corresponds to a shifting movement of the cylindrical mantle surface 7 in the direction of the arrow A and in correspondence with FIG. 2, so that the inner annular chamber 9 is opened. In such a position, the material contained within the annular chamber 10 can be hydrolysed by supplying steam under pressure via the radial bore 58, noting that no pressurized steam is supplied via the connection 45. In the shifted position of the tubular control slide valve 18 as shown in FIG. 7, both radial bores 27 and 28 are closed by the tubular control slide valve 18, so that both cylindrical mantle surfaces 7 and 8 arrive at their closed position when subjecting to pressure the cylindrical space 25 via the connection 45. In such a position, in which no steam pressure or pressure of pressurized fluid acts within the bore 26, dewatering can be performed within the inner annular chamber 9 and hydrolysis can be effected in the outer annular chamber 10, noting that the steam required for the hydrolysis step can be introduced into the outer annular chamber 10 via the annular gap 54 and the perforation 55 in the front disc 49.

Finally, in the shifted position of the tubular control slide valve 18 shown in FIG. 8, the radial perforation 57 of the control slide valve 18 arrives at a position being in alignment with the radial bore 27, whereas the radial bore 28 is shut off. In such a shifted position, the cylindrical mantle surface 7 remains in its closed position and the inner annular chamber 9 remains closed. However, the outer annular chamber 10 is opened, because the cylindrical mantle surface 8 is moved in the direction of the arrow A into its shifted position. In this position, the content of the outer annular chamber 10 is discharged and is transferred to the discharge means for the treated and dewatered material. In this shifted position, steam supply via the connection is kept open.

As can be further derived from the representation according to FIG. 2, the outer mantle surface 8 of both cylindrical mantle surfaces carries at its outer side a peeling knife 64 which cooperates with the inner wall 65 of the stationary housing 2 during shifting movement of the outer cylindrical mantle surface 8 and thus ensures complete discharging in direction to the discharge opening 21.

What is claimed is:

1. A solid jacket centrifuge comprising:

at least two rotatable and water impermeable mantles arranged concentrically with respect to each other and mounted for shifting movement along a longitudinal axis of the centrifuge;

means for shifting the mantles independently in either direction along the longitudinal axis of the centrifuge;

means for charging material to be dewatered into the centrifuge;

means for discharging liquid from the centrifuge;

means, adjoining the mantles in a radial direction, for discharging dewatered material and for cooperating with at least one mantle of the at least two mantles such that axial movement of said at least one mantle effects opening of the means for discharging the dewatered material.

2. The centrifuge according to claim 1 wherein:
said means for discharging liquid from the centrifuge is connected radially to the centrifuge between the at least two mantles.

3. The centrifuge according to claim 1 wherein:
said at least two mantles define annular chambers with front surfaces; and
said means for charging material to be dewatered into the centrifuge is connected radially to the centrifuge at the front surfaces of the annular chambers.

4. The centrifuge according to claim 3, further comprising:
a steam supply conduit connected to at least one of the annular chambers.

5. The centrifuge according to claim 4 wherein:
said at least two mantles further define control cylinders therein and carry annular discs guided within the control cylinders.

6. The centrifuge according to claim 5 wherein:
said control cylinders have internal spaces connected with the steam supply conduit via radial channels leading therefrom.

7. The centrifuge according to claim 6, further comprising:
at least one paraxial tube means, penetrating at least one of the annular discs, for supplying steam to said internal spaces.

8. The centrifuge according to claim 6, further comprising:
a tubular slide valve means, arranged within the steam supply conduit, for shifting movement along the longitudinal axis of the centrifuge such that the tubular slide valve means may be brought into and out of alignment with the radial channels.

9. The centrifuge according to claim 3 wherein:
at least one of said front surfaces of the annular chambers is a sieve surface with perforations conically flaring in an outward direction and is fixed against shifting movement along the longitudinal axis of the centrifuge.

10. The centrifuge according to claim 9 wherein:
one other of said front surfaces of the annular chambers is slidingly guided and supported by one of the at least two mantles along the longitudinal axis of the centrifuge.

11. The centrifuge according to claim 3 wherein:
said front surfaces are each provided with an armor coating.

12. The centrifuge according to claim 3 wherein:
at least one of the annular chambers has radially protruding drivers with conical surfaces arranged therein.

13. The centrifuge according to claim 12 wherein:
said at least one of the annular chambers also contains an elastic body which can change its volume when subjected to the action of pressurized fluid.

14. The centrifuge according to claim 1, further comprising:
a central shaft means, arranged along the longitudinal axis of the centrifuge, for driving the material charging means; and
a drive means for rotating the central shaft means.

15. The centrifuge according to claim 14, further comprising:
radial support webs surrounding the central shaft means.

16. The centrifuge according to claim 15, further comprising:
elastic ring means, arranged adjacent to the radial support webs, for damping vibrations within the centrifuge.

17. The centrifuge according to claim 14, further comprising:
a stationary tube means, bearingly supported along the longitudinal axis of the centrifuge, for transferring material to be dewatered from the material charging means to the centrifuge.

18. The centrifuge according to claim 14 wherein:
said drive means includes means for adjusting the rotating speed thereof.

19. The centrifuge according to claim 1 wherein:
said mantles are lined with ceramic material.

20. The centrifuge according to claim 1, further comprising:
knife means, arranged inside at least one mantle of the at least two mantles, for peeling material therefrom upon axial movement of said at least one mantle.

* * * * *